US011691308B2

(12) United States Patent
Duff, Jr. et al.

(10) Patent No.: US 11,691,308 B2
(45) Date of Patent: Jul. 4, 2023

(54) RAZOR BLADES WITH ALUMINUM MAGNESIUM BORIDE ($ALMGB_{14}$)-BASED COATINGS

(71) Applicant: The Gillette Company LLC, Boston, MA (US)

(72) Inventors: Ronald Richard Duff, Jr., Shrewsbury, MA (US); Jeffrey Stuart Parker, Quincy, MA (US); Yongqing Ju, Kronberg (DE); Xiandong Wang, Acton, MA (US)

(73) Assignee: The Gillette Company LLC, Boston, MA (US)

( * ) Notice: Subject to any disclaimer, the term of this patent is extended or adjusted under 35 U.S.C. 154(b) by 755 days.

(21) Appl. No.: 15/894,297

(22) Filed: Feb. 12, 2018

(65) Prior Publication Data

US 2018/0162000 A1 Jun. 14, 2018

Related U.S. Application Data

(62) Division of application No. 13/561,904, filed on Jul. 30, 2012, now abandoned.

(Continued)

(51) Int. Cl.
*B26B 21/60* (2006.01)

(52) U.S. Cl.
CPC ..... *B26B 21/60* (2013.01)

(58) Field of Classification Search
CPC ..... B22F 2998/10; B22F 1/0003; B22F 3/02; B22F 3/1216; B22F 5/12; B22F 1/02; B22F 1/025; B22F 7/02; B24C 11/00; B24C 1/083; B24C 1/08; B24C 11/005; B24C 1/00; B24C 1/086; B24C 7/00; B24C 9/003; B24C 9/006; B24C 1/06; C09K 3/1409; B26B 21/60; A01D 46/16; B29C 67/0055; B29C 47/0852; B29C 2947/92571;

(Continued)

(56) References Cited

U.S. PATENT DOCUMENTS 4,807,360 A 2/1989 Cerier et al.
5,121,660 A 6/1992 Kramer (Continued)

FOREIGN PATENT DOCUMENTS

CH 240016 11/1945
CN 101786883 7/2010

(Continued)

OTHER PUBLICATIONS

Kurt Kleiner, Material slicker than Teflon discovered by accident, NewScientist dated Nov. 2008, 2 pages.

(Continued)

*Primary Examiner* — Ghassem Alie
(74) *Attorney, Agent, or Firm* — Joanne N. Pappas; Kevin C. Johnson

(57) ABSTRACT

This invention relates to a novel application of hard, low friction aluminum magnesium boride ($AlMgB_{14}$, also known as BAM) based ceramic coatings to surfaces of razor components and in particular to blade edges of razor blades. On razor blade edges, these coatings may elevate blade performance, while also simplifying the manufacturing process.

11 Claims, 8 Drawing Sheets

Related U.S. Application Data

(60) Provisional application No. 61/515,597, filed on Aug. 5, 2011.

(58) Field of Classification Search
CPC ..... B29C 47/0002; B29C 47/0014; B29C 47/0864; B29C 47/862; B29C 47/025; B29C 47/0866; B29C 47/822; B29C 47/88; C23C 14/00; C23C 14/027; C23C 14/0605; C23C 14/3414; C23C 14/024; C23C 14/06; C23C 14/067; C23C 14/0688; C23C 14/246; C23C 14/352; C23C 14/3407; C23C 14/46; E21B 10/43; E21B 10/46; E21B 10/62; E21B 10/22; E21B 10/567; E21B 10/5673; E21B 10/573; E21B 10/58; E21C 2035/1826; E21C 35/183
See application file for complete search history.

(56) References Cited

U.S. PATENT DOCUMENTS

| | | | |
|---|---|---|---|
| 5,477,756 | A | 12/1995 | Trankiem et al. |
| 5,795,648 | A | 8/1998 | Goel et al. |
| 6,099,605 | A | 8/2000 | Cook et al. |
| 6,468,642 | B1 | 10/2002 | Bray et al. |
| 6,607,782 | B1 | 8/2003 | Malshe et al. |
| 6,684,513 | B1 | 2/2004 | Clipstone et al. |
| 7,060,367 | B2 | 6/2006 | Yamada et al. |
| 2003/0219605 | A1 | 11/2003 | Molian et al. |
| 2007/0124944 | A1 | 6/2007 | Thoene et al. |
| 2010/0008980 | A1 | 1/2010 | Brichard et al. |
| 2010/0011595 | A1 | 1/2010 | Claus et al. |
| 2010/0028641 | A1* | 2/2010 | Zhu ..... C23C 14/0605 428/220 |
| 2011/0010950 | A1 | 1/2011 | Madeira et al. |
| 2011/0017318 | A1 | 1/2011 | Pisot |
| 2013/0031794 | A1 | 2/2013 | Duff, Jr. et al. |
| 2015/0328789 | A1* | 11/2015 | Skrobis ..... B26B 21/60 30/346.54 |

FOREIGN PATENT DOCUMENTS

| | | | | |
|---|---|---|---|---|
| EP | 1287953 | A1 * | 3/2003 | ..... B26B 21/60 |
| RU | 2071412 | C1 | 1/1997 | |
| WO | 9219425 | A2 | 11/1992 | |
| WO | WO 03068503 | | 8/2003 | |
| WO | WO 2006/001791 | A1 | 1/2006 | |
| WO | WO 2006/114682 | A2 | 11/2006 | |
| WO | WO 2006/138153 | A1 | 12/2006 | |

OTHER PUBLICATIONS

All Office Actions, U.S. Appl. No. 13/561,904, filed Jul. 30, 2012.
PCT Search Report and Written Opinion for PCT/US2012/049137 dated Oct. 24, 2012, 8 pages.

* cited by examiner

RAZOR BLADES WITH ALUMINUM MAGNESIUM BORIDE ($ALMGB_{14}$)-BASED COATINGS

FIELD OF THE INVENTION

The apparatus relates generally to razor blades, and more particularly, to novel coatings on razor blade edges.

BACKGROUND OF THE INVENTION

Current razor blades typically include a sharpened substrate, such as stainless steel, a hard coating(s) to optimize edge strength, tip shape, wear resistance, etc. layered on top of the stainless steel and a soft coating(s) generally of polymeric material, such as telomer, layered on top of the hard coating(s) to impart lubricity.

It is generally known that the combination of the sharpened blade profile and the hard and lubricious coatings generally define the performance of the blade element. Generally, of interest are coating options which may improve a blade element's hard coating performance and/or increase blade lubricity.

It would be desirable to optimize blade coatings and/or steps required in the blade production, while maintaining or improving blade performance.

SUMMARY OF THE INVENTION

In accordance with the invention, a razor blade apparatus includes a sharpened substrate having at least one layer of BAM material disposed thereon. In a preferred construction of the present invention, the at least one layer of BAM material is directly disposed on the sharpened substrate. One or more interlayers may be disposed between the BAM layer and the sharpened substrate and one or more overcoat layers may be disposed on top of the BAM layer. The interlayer and overcoat layer include an adhesion layer which may be comprised of niobium, chromium, platinum, titanium, or any combination or alloys thereof.

In an embodiment of the present invention, at least one polymeric material is disposed on top of the at least one BAM layer, on top of said one or more interlayer, or on top of said one or more overcoat layer, or any combination thereof. The polymeric material includes PTFE or a material with a coefficient of friction greater or lesser than that of PTFE.

The overcoat layer of the present invention may include a composite of BAM and a second component. The second component could be a polymeric material.

In another aspect of the present invention, the overcoat layer includes an increasing concentration of the second component (e.g., the polymeric material) in a direction towards an outer surface of the substrate or a decreasing concentration of the second component (e.g., polymeric material) in a direction towards an outer surface of the substrate.

The at least one BAM layer of the present invention is disposed on the sharpened substrate via physical vapor deposition, such as magnetron sputtering, chemical vapor deposition, or any combination thereof.

The sharpened substrate may include stainless steel, metal, ceramic, composite, plastic, glass, or any combination thereof.

In a preferred aspect of the present invention, the sharpened substrate is on a blade edge of the razor blade. The blade edge could be linear, non-linear, or any combination thereof.

In a further aspect of the present invention, the BAM layer provides antimicrobial properties.

In an alternate embodiment of the present invention, a shaver apparatus includes a component having at least one layer of BAM material disposed thereon. The component may be a non-cutting element, a cutting element. The non-cutting elements contemplated by the present invention include a cartridge or handle component, such as a clip in a wet shaver or an outer or inner surface of a foil disposed in an electric dry shaver. The cutting element could be a cutter element in an electric dry shaver or a razor blade edge in a wet shaver.

A method of making a razor blade includes providing a sharpened substrate and depositing at least one layer of BAM material on an outer surface of the substrate.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
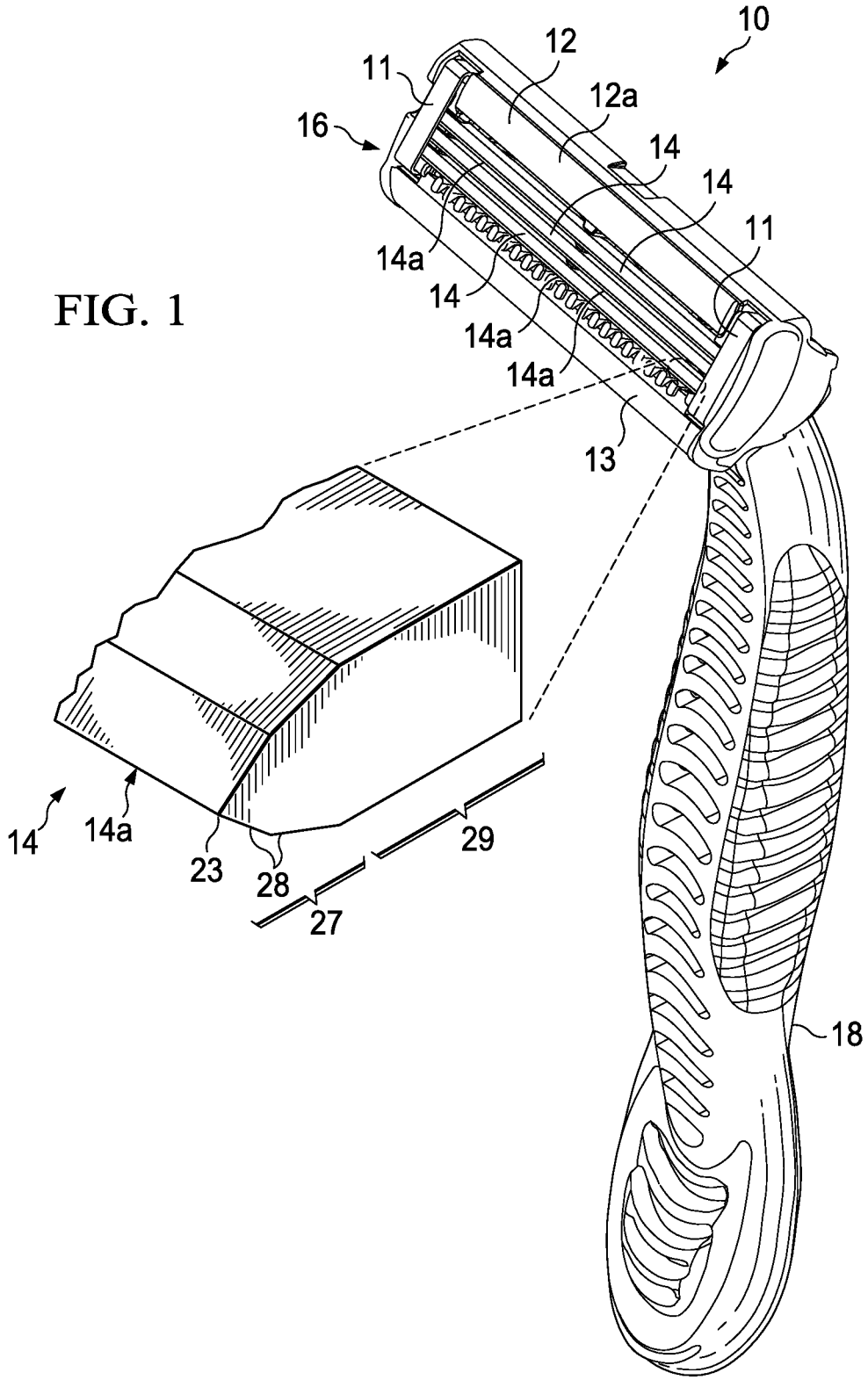
FIG. 1 is a perspective view of a razor having a cartridge and a handle and blade edges having BAM disposed thereon in accordance with the present invention.

This invention relates to a novel application of aluminum magnesium boride ($AlMgB_{14}$, also known as BAM) based ceramic coatings to surfaces of razor components and in particular to blade edges of razor blades, as described herein. Applicants are not aware of BAM materials being used or suggested for use with razor blades. The hard and/or low friction properties of the BAM coating may provide significant benefits on razor blade edges, as these coatings may elevate blade performance and/or simplify the manufacturing process.

Baseline BAM material generally contains elemental aluminum, magnesium, and boron. The terms "BAM" or "BAM material" or "BAM layer" or "$AlMgB_{14}$" or "BAM-based" or "BAM alloy" or "BAM like" will generally be used interchangeably herein and may signify the base material $AlMgB_{14}$ itself, a derivative of the material such as the metal boride $XYB_{14}$, where X and Y are metal atoms, or the material comprised of the base $AlMgB_{14}$, or $XYB_{14}$, combined with a variety of single or multi-element additives, alloys, or agents which may have some impact on its properties. BAM without additive components is sometimes called base or baseline material to distinguish it from a BAM material containing second phase or solid solution additives or other elements. The additives may generally include, though would not be limited to, components such as silicon, carbon, titanium diboride ($TiB_2$), aluminum nitride (AlN), boron nitride (BN), and/or alloying agents.

BAM ($AlMgB_{14}$) is a chemical compound of aluminum, magnesium and boron, and is a ceramic alloy that is generally highly resistive to wear with a low coefficient of friction. It should be noted that BAM material may generally become harder when certain elements or compounds are added to the BAM baseline material. For instance, baseline BAM material may typically display microhardness of about 32 GPa to about 35 GPa, but additions such as titanium diboride ($TiB_2$) may increase the microhardness to about 45 GPa producing one of the hardest known bulk materials. BAM materials have demonstrated some of the lowest coefficients of friction of currently known solids, (e.g., less than 0.05 and as low as about 0.02) as disclosed in Eaton Corporation's Final Technical Report entitled *Nanocoatings for High-Efficiency Industrial Hydraulic and Tooling Systems*, Award No. DE-FG36-06G016054, dated Dec. 31, 2010, while the known coefficient of friction for Teflon (e.g., PTFE) widely used in commercially available razor blades as coatings for providing lubricity is generally known to be in the range of about 0.05 to about 0.10.

Consequently, a coating on a razor blade comprising BAM has the potential to exceed functionality of the current discrete hard & lubricious (e.g., low friction) coatings applied to razor blade edges in a single coating application. Since the BAM coatings will generally be both hard and low friction (e.g., slippery), they may desirably provide a single coating solution for blade edges. The need for a soft lubricious overcoat layer and/or other inter-layers such as adhesion layers or the like, may or may not be sought-after, depending on desired attributes of the blade edges and characteristics of applied BAM coating. Not having additional layers, potentially eliminates required processing steps of those layers (e.g., spray & sinter, telomer thinning), resulting in simplified manufacturing while potentially yielding a product with enhanced performance.

Furthermore, the hard nature itself of BAM coatings could result in several improvements to the blade. BAM coatings applied to standard sharpened blade substrates or geometries may outperform current hard coatings providing enhanced edge strength and wear resistance. BAM coatings may also be applied to different blade profiles which may result in further optimized blade performance.

The apparatus for processing blades with the BAM material desirably includes processes which are used currently, namely Physical Vapor Deposition (PVD) such as magnetron sputtering, however other feasible methods known in the art such as Chemical Vapor Deposition (CVD) are also contemplated as applicable processing techniques in the present invention. While stainless steel is the desired substrate of the present invention, as it is the common substrate for razor blades, blade substrates comprised of another metal or metals, ceramic, composite, plastic, glass, or any combination thereof, are also contemplated in the present invention. The BAM material coatings, by being applied to other razor cartridge components, may improve wear resistance and/or glide during shaving, particularly if disposed on clips or other hair and/or skin management components.

The term "razor blade" in the present invention desirably signifies a "substrate" comprised of stainless steel which includes a blade body and at least one flank. Desirably, a razor blade includes two flanks forming a blade edge and a blade body. The two flanks intersect at a point or tip, or what is oftentimes referred to as the ultimate tip. Each flank may have one, two or more bevels. The blade body is generally the remaining area of the razor blade beneath the flanks or bevels. As shown in a call-out section of FIG. 1, blade 14 includes blade body 29, two bevels 28 for each of two flanks 27 which intersect at tip 23 forming a blade edge 14*a*. A "substrate" signifies the substance or material acted upon in the present invention. Illustrative embodiments herein relate to a stainless steel substrate commonly used for razor blade formation.

Turning now to FIG. 1, a razor 10 generally includes a shaving or cartridge unit 16 attached to a handle 18 with the shaving unit 16 having one or more blades 14 (e.g., 3 blades shown) each with a sharpened edge 14*a* in accordance with the present invention. A cap 12 and guard 13 may also be included in the shaving unit 16, the cap 12 preferably including a shaving aid composite 12*a* affixed thereon. The shaving unit 16 may be adapted for coupling and uncoupling from the razor handle 18 such that a new cartridge unit 16 may be coupled to the handle when the blades become dull or may be integral with a handle 18 so that the complete razor 10 is discarded when the blades become dull. It is noted that one or more of the blades 14 in FIG. 1 has a BAM material disposed thereon, preferably on the blade edge region.

Figure 2:
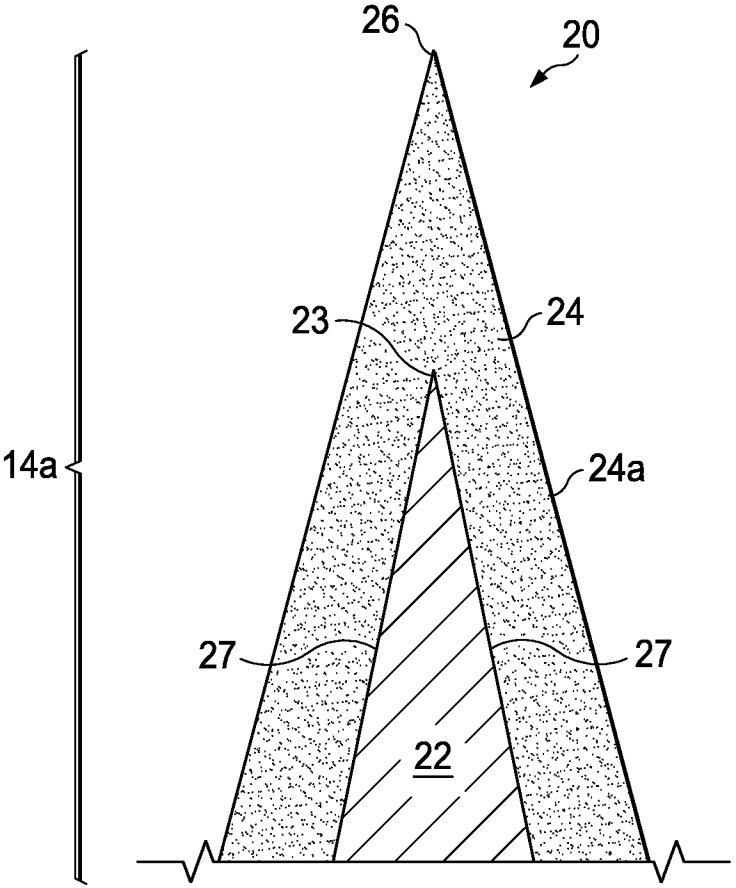

A diagrammatic view of a blade or sharpened substrate, and in particular the blade edge region 20 of blade edge 14*a* of FIG. 1, is shown in FIG. 2 of the present invention. The blade includes a stainless steel substrate 22 with a sharpened edge formed in a sequence of honing operations that forms a tip portion 23 with a radius typically less than 500 angstroms and edge flanks 27 which may or may not include one or more bevels 28 as shown in the call-out section of FIG. 1. Deposited on the tip 23 and flanks 27 of substrate 22 is at least one layer of BAM material 24 in accordance with a preferred embodiment of the present invention. The thickness of the BAM material 24 may desirably range from about 300 angstroms to about 5000 angstroms and preferably range from about 500 angstroms to about 1800 angstroms, and may or may not be uniformly deposited throughout the tip and flanks. It should be noted that the BAM material may be deposited despite any variation in lengths of flanks 27, angles, and aspect ratios (e.g., the ratio of the distance from the blade tip portion 23 to the BAM tip 26 and the width of BAM material coating 24 at the tip portion 23).

The BAM coating may extend from the ultimate tip to any length down the blade edge flanks 27 and may or may not extend to the blade body 29.

As noted above, the apparatus for processing blades of this type may desirably include magnetron sputtering while other feasible methods known in the art are also contemplated as applicable processing techniques in the present invention.

In addition, due to the presence of boric acid molecules at the outer surface 24*a* of the BAM layer 24, the BAM layer 24 may inherently provide anti-microbial properties ostensibly acting as a barrier to the growth of bacteria, fungus, and other organisms on the razor blades themselves which in turn may provide a clean blade to a user's skin.

Figure 3:
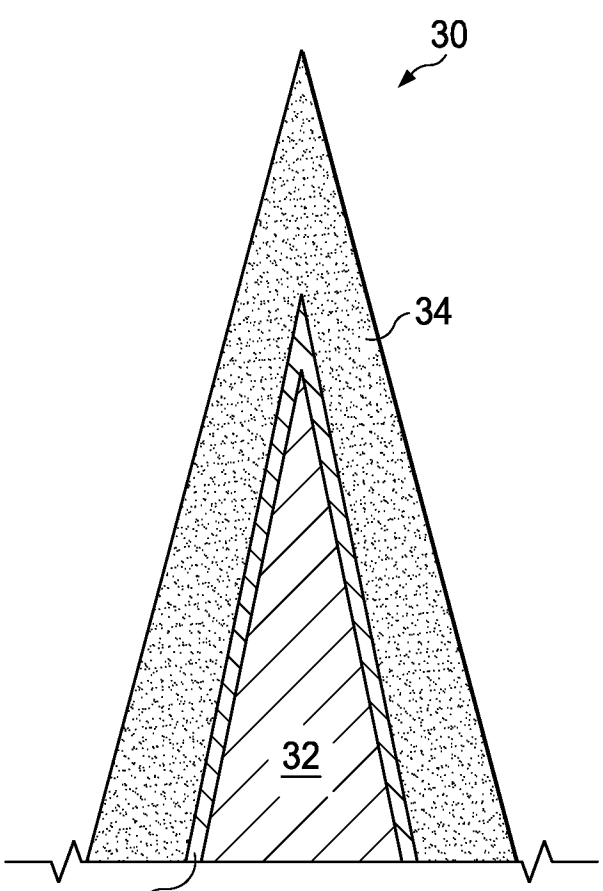
FIGS. 2-10 are each a diagrammatical view of a blade edge of FIG. 1 in accordance with the present invention.

In a first alternate embodiment of the present invention, FIG. 3 depicts blade edge region 30 having one or more interlayer 36 disposed between a BAM material coating or layer 34 and a stainless steel substrate 32. The interlayer 36 may desirably include an adhesion layer which may include niobium, chromium, platinum, titanium, or alloys of the aforementioned and/or any combination thereof. The interlayer 36 may have a thickness of about 200 to about 400 angstroms. The interlayer 36 may be desirably disposed between the substrate 32 and the BAM material coating 34 to assist in adherence of the BAM coating 34 to the substrate 32.

Figure 4:
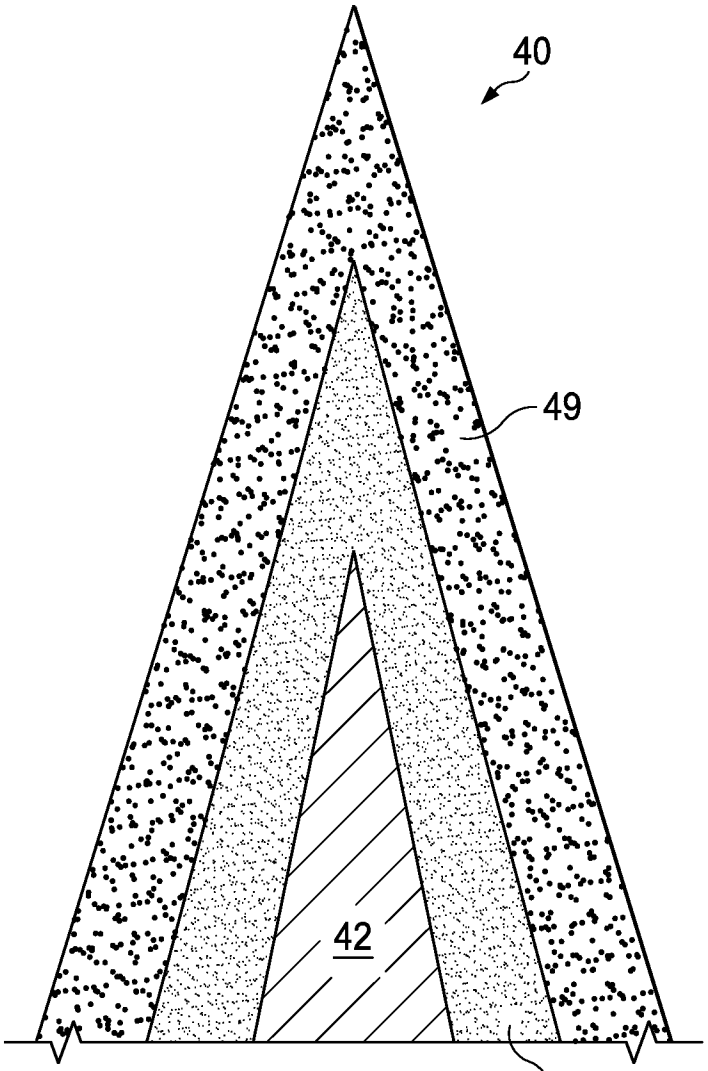

In a second alternate embodiment of the present invention, FIG. 4 depicts a blade edge region 40 with one or more overcoat layers 49 disposed on top of the BAM material layer 44 which is disposed on top of the stainless steel substrate 42. In the present invention, the overcoat layer 49 (and other polymeric layers described herein) may desirably be comprised of a polymeric material that is generally highly lubricious, such as a fluoropolymer (e.g., polytetrafluoroethylene telomer, oftentimes referred to as PTFE) or may be comprised of a polymeric material or other materials that is/are generally more or less lubricious (e.g., having a coefficient of friction lesser or greater than that of the PTFE, respectively). Providing a telomer (e.g., PTFE) on the outermost surface of the blade edge endows a user's skin with lubriciousness on contact. The lubricious overcoat layer 49 of FIG. 4 and other similar layers described herein may have a thickness of about 200 angstroms or higher.

Thus, in the present invention, even while the BAM layer 44 innately may generally provide both hard and lubricious properties, augmented lubricity may be desired to provide adequate or enhanced shaving attributes (e.g., glide, less tug and pull), and as such a lubricious material such as PTFE may be added to the edge region 40 on top of the BAM layer 44. Similarly, if even with the BAM layer 44, less lubricity may be desirable to provide adequate or enhanced shaving attributes, a non-lubricious material such as polypropylene may be added to the edge region 40 on top of the BAM layer 44. Different properties on blade edges may be desirable in a blade unit.

Figure 5:
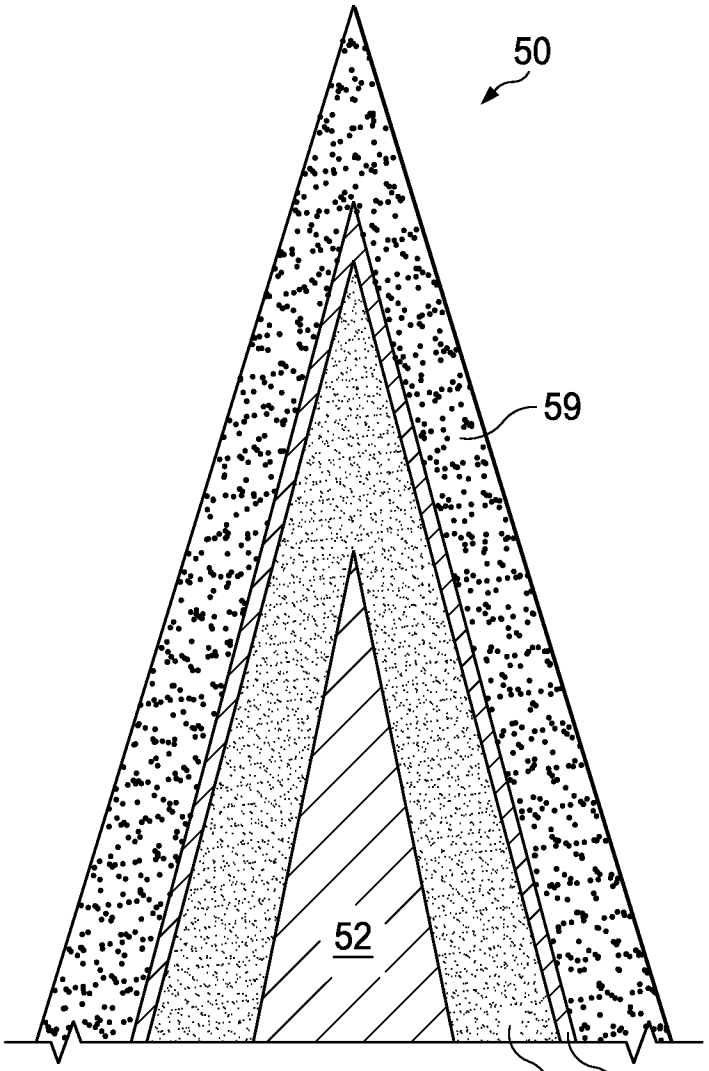

As shown in a third alternate embodiment of the present invention in FIG. 5, the embodiment of FIG. 4 may include a stainless steel substrate 52 and one or more adhesion layer 58 which may be comprised of niobium, chromium, platinum, titanium, or alloys of the aforementioned and/or any combination thereof. The adhesion layer 58 may have a thickness of about 200 to about 400 angstroms. The adhesion layer 58 may be desirable to assist in adhering the polymeric layer or PTFE layer 59 onto the BAM material layer 54, which is disposed on substrate 52 or for providing added hardness to the edge region 50.

Figure 6:
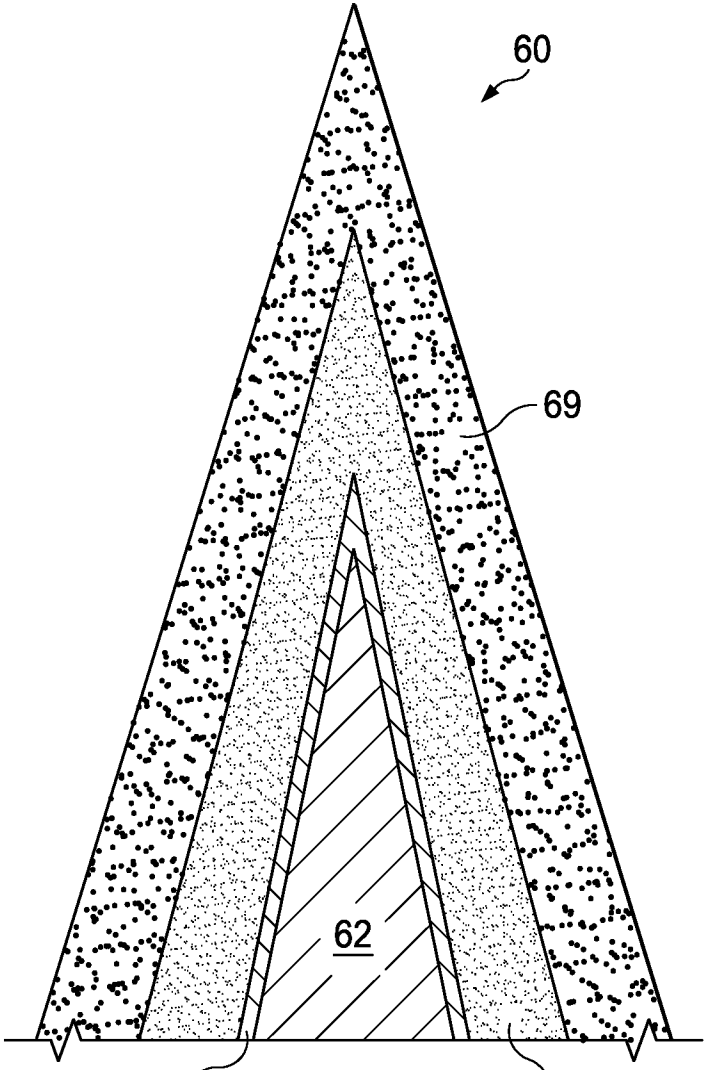

In a fourth alternate embodiment of the present invention shown in FIG. 6, the embodiment of FIG. 4 is modified depicting a blade edge region 60 with one or more polymeric overcoat layers 69 disposed on top of BAM material layer 64 and one or more interlayers 66 disposed between the BAM layer 64 and the substrate 62. As above, the outer layer 69 may desirably be comprised of a polymeric material such as a PTFE telomer while interlayer 66 may desirably be an adhesion layer comprising niobium, chromium, platinum, titanium, or alloys of the aforementioned and/or any combination thereof. The layer 66 may have a thickness in the range of about 200 to about 400 angstroms. By its location, the interlayer 66 may desirably assist in adherence of the BAM material 64 to the substrate 62 may provide added hardness or rigidity to the edge region 60. The polymeric outer layer 69 may desirably provide lubriciousness to the outermost surface which touches a user's skin thereby imparting a more comfortable shave.

Figure 7:
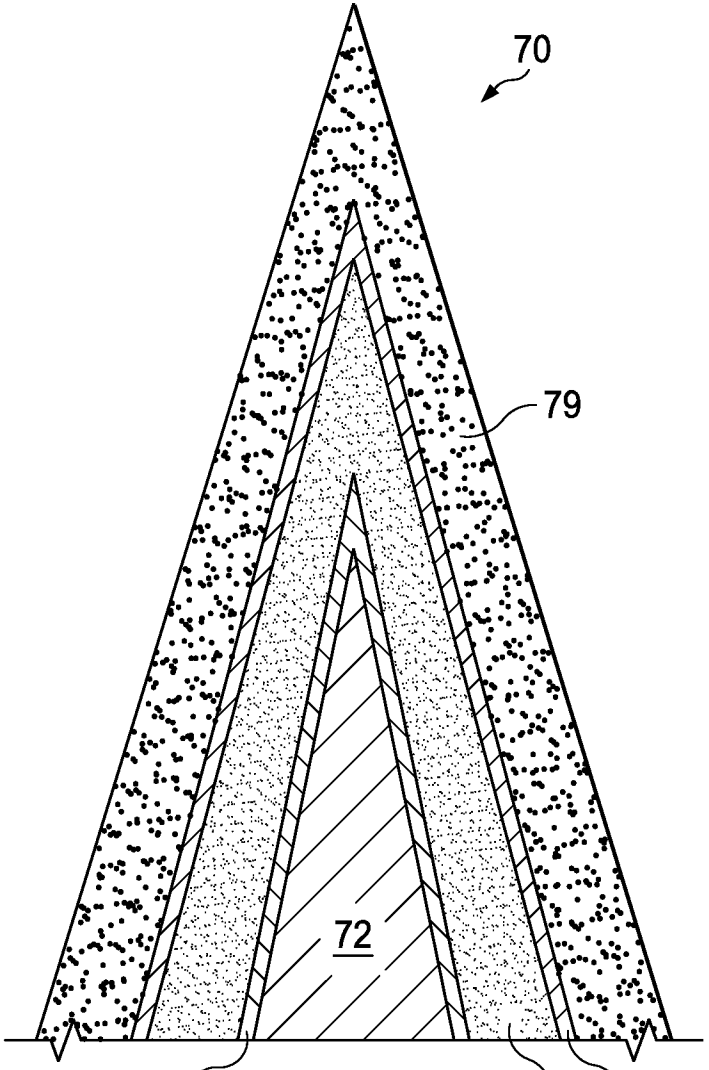

The fifth embodiment shown in FIG. 7 is a modification of FIG. 6 and includes blade edge region 70 which is substantially identical to the blade edge region 60 having a substrate 72, a BAM layer 74, an interlayer 76, and a polymeric overcoat layer 79 with the only difference from FIG. 6 being the addition of an adhesion layer 78. The newly added adhesion layer 78 is of the type described previously in conjunction with FIG. 5's adhesion layer 58.

The overcoat layer of polymeric material of the present invention may be partially removed if desired to provide a thinner more uniform layer using any known methods and for example, the processes described in U.S. Pat. No. 5,985,459, entitled Method of Treating Razor Blade Cutting Edges, issued on Nov. 16, 1999, assigned to the assignee hereof, and incorporated by reference in its entirety.

Figure 8:
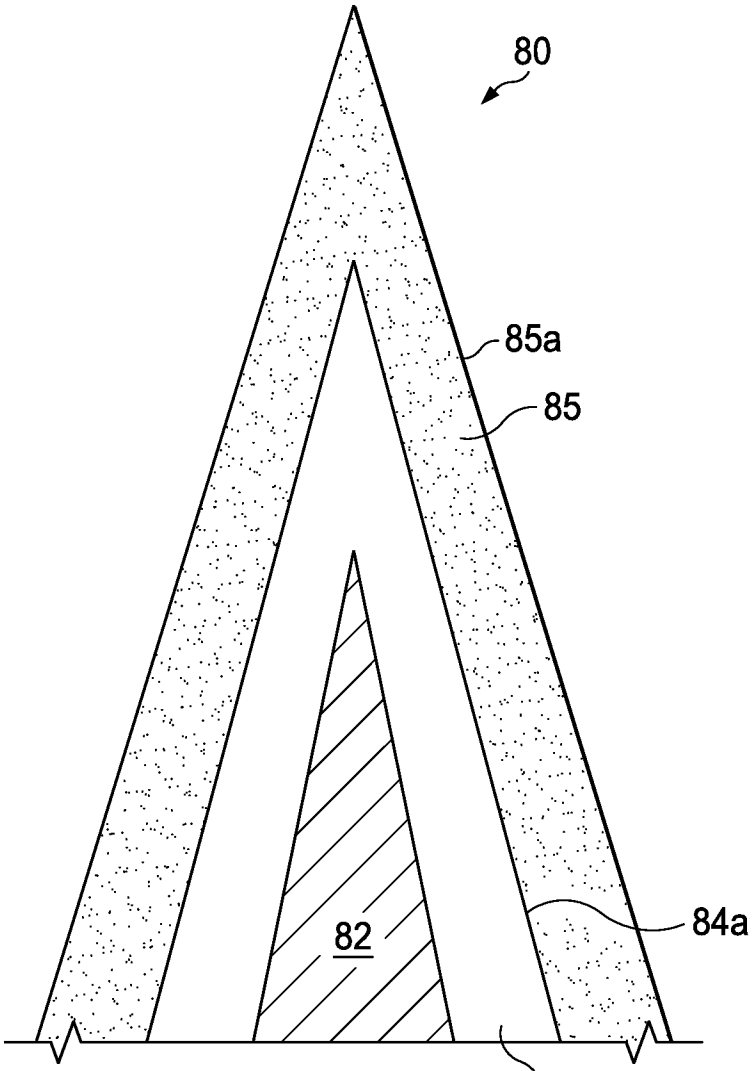

Referring now to FIG. 8, yet another embodiment of the present invention edge region 80 is depicted where at least one BAM layer 84 is disposed over the substrate 82 (as in FIG. 2), but in FIG. 8, at least one BAM overcoat layer 85 is additionally disposed on BAM layer 84. The BAM overcoat layer 85 comprises a composite including the BAM material and at least one other element or compound, the latter material being desirably comprised of PTFE or another polymeric material. In this way, BAM overcoat layer 85 has an outer surface 85*a* which may be more or less lubricious than the surface 84*a* would have been had the overcoat layer 85 not been disposed thereon.

Figure 9:
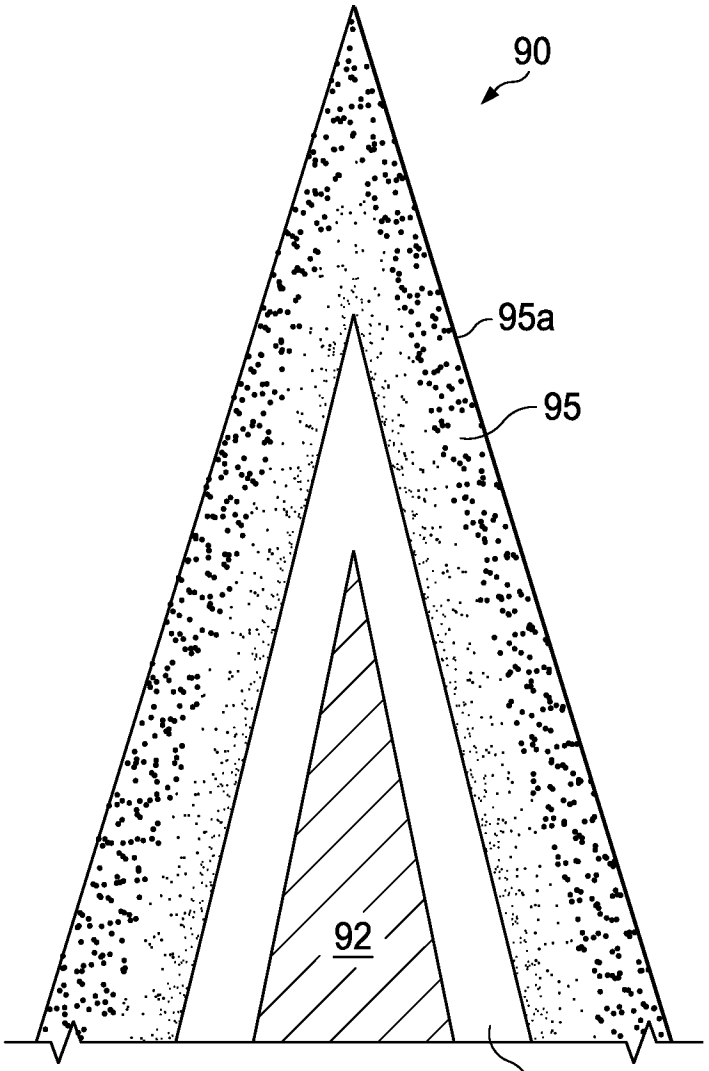

In FIG. 9, in accordance with the present invention, a modification of the embodiment of FIG. 8 is depicted indicating a blade edge region 90 having a BAM overcoat composite layer 95 wherein the component materials are combined within the layer in concentration gradient. With an overcoat layer 95 comprising a composite of BAM material and at least one other element or compound desirably comprised of PTFE, the gradient is desirably formed such that the PTFE compound of the overcoat layer 95 increases in concentration in the direction from BAM layer 94's outer surface towards outer surface 95*a* of the blade edge. Accordingly, the BAM material itself decreases in concentration in the direction from BAM layer 94's outer surface towards outer surface 95*a*. Thus, if the BAM layer 94 is not, in and of itself, lubricious enough, increases in the concentration of PTFE towards the surface 95*a* in the manner depicted in FIG. 9 (within the BAM overcoat layer 95) could theoretically improve shaving attributes resulting in better glide, less tug and pull, improved overall comfort as well as less nicks and cuts.

If desirable, the concentration gradient mentioned above may be reversed, in that the BAM overcoat layer 95 would have increasing concentrations of the BAM material in the direction from the outer surface of the BAM layer 94 towards outer surface 95*a* and the PTFE compound of the BAM overcoat layer 95 decreases in concentration in the direction from BAM layer 94's outer surface towards outer surface 95*a*.

It should be noted that the presence of a concentration gradient as described in FIGS. 8 and 9 in the present invention is contemplated for BAM layers as well, with or without the presence of a BAM overcoat layer.

With the embodiments described as having an overcoat layer (e.g., layers 58 and 78 in FIGS. 5 and 7), the present invention contemplates still further that a BAM overcoat layer 95 may be disposed on top of any overcoat layer (e.g., layers 58 and 78 in FIGS. 5 and 7) rather than directly disposed over the BAM layer 94.

Moreover, the BAM overcoat layer 95 may be a composite comprised of the BAM material and several other elements or compounds, in lieu of or in addition to the PTFE mentioned herein offering the benefits of lubriciousness for instance.

It is further contemplated in the present invention that the BAM material layer 94 itself is formed having a concentration gradient.

Figure 10:
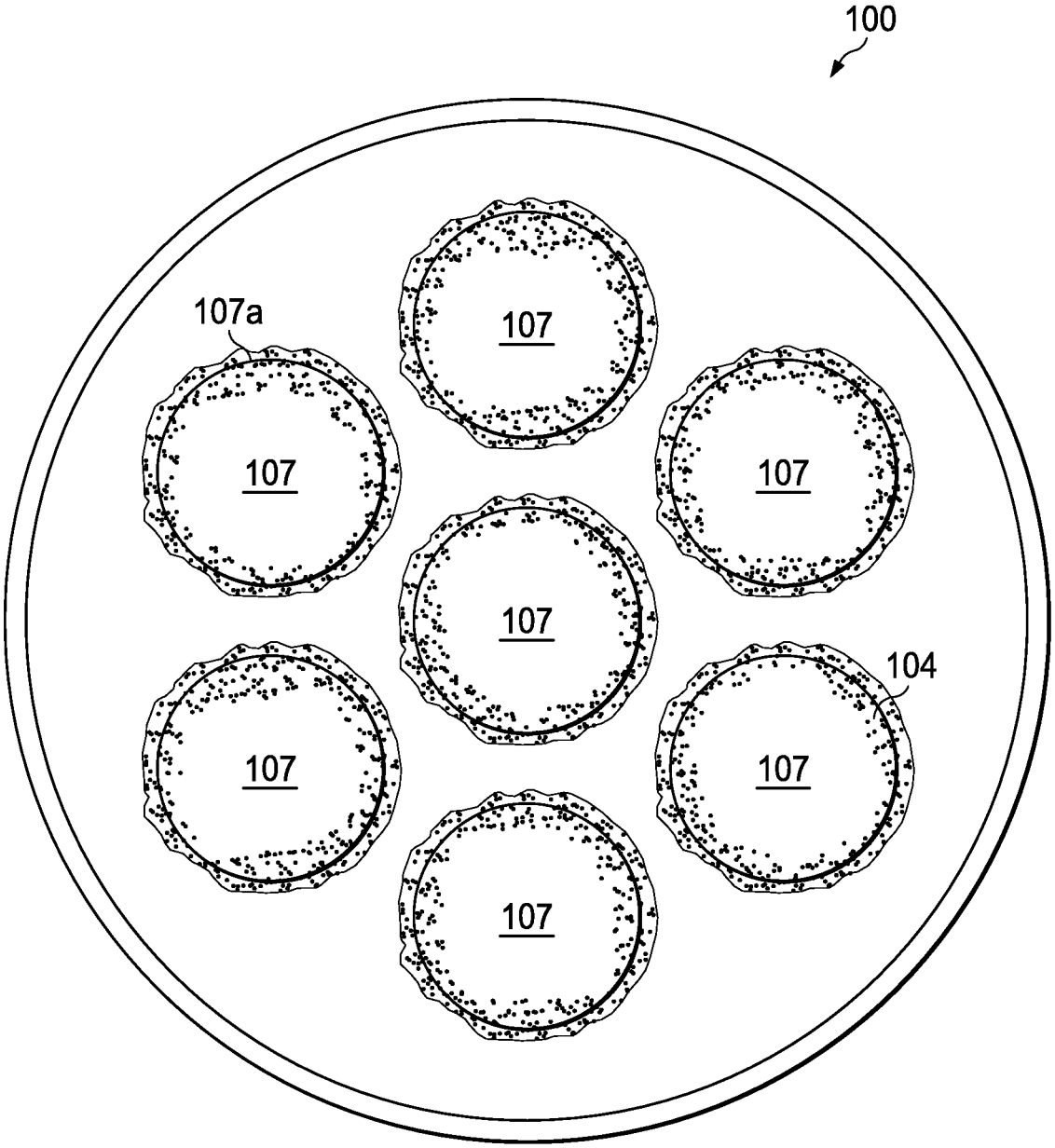

The embodiments described herein have generally described linear blades with generally planar or straight edge regions and bevels. However, the present invention further contemplates the BAM material 104 disposed on upper surfaces 107 of non-linear (shown as circular) blade unit edges 107*a* of substrate (not shown) in blade edge region 100 as depicted in FIG. 10. The BAM material may be deposited using any of the processes described herein. It follows that any of the alternate embodiments shown in FIGS. 2-9 in conjunction with linear blades, can be similarly extended to the embodiment in FIG. 10. For instance, in conjunction with FIGS. 3 and 6, the non-linear blade edge of FIG. 10 may first be coated with an interlayer (not shown in FIG. 10) on top of which a BAM material 104 layer is deposited.

The non-linear blade edges of the present invention may be of the types described in U.S. Pat. No. 4,807,360 entitled Shaving Device, issued on Feb. 28, 1989, and/or U.S. Pat. No. 4,875,228 entitled Shaving Device, issued on Oct. 24, 1989, both assigned to the assignee hereof, and incorporated by reference in their entireties.

The present invention further contemplates the BAM material in addition to being deposited on blade edges, being deposited on any other razor components, such as those components designated in FIG. 1. The coatings of BAM material, if applied to other razor cartridge components, may theoretically improve wear resistance and/or glide during shaving, particularly if disposed on clips or other hair and/or skin management components.

Figure 11:
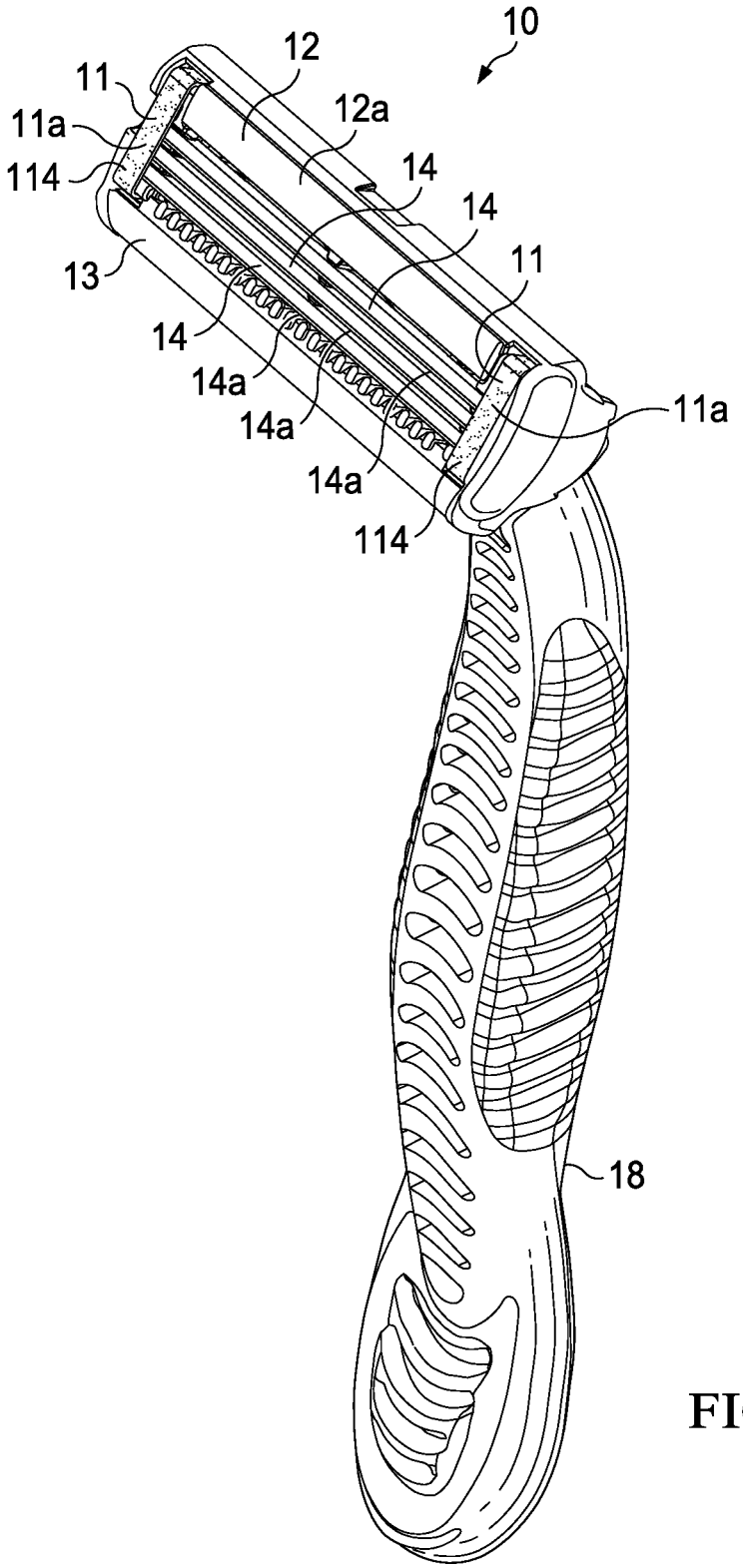
FIG. 11 is a perspective top view of a razor having a cartridge and a handle and blade clips having BAM disposed thereon in accordance with the present invention.

Referring now to FIG. 11, an example of a BAM material 114 disposed on razor cartridge components, the two blade retaining clips 11 of FIG. 1 are shown in accordance with another embodiment of the present invention. The shaving benefits of glide and comfort along the shave path may be augmented by adding the BAM material (e.g., a hard and lubricious material) on the upper surface 11*a* of the clips 11 which are generally disposed on the left and right sides of the cartridge. The BAM material 114 may be deposited by means of magnetron sputtering, as described above, or other feasible methods.

Figure 12:
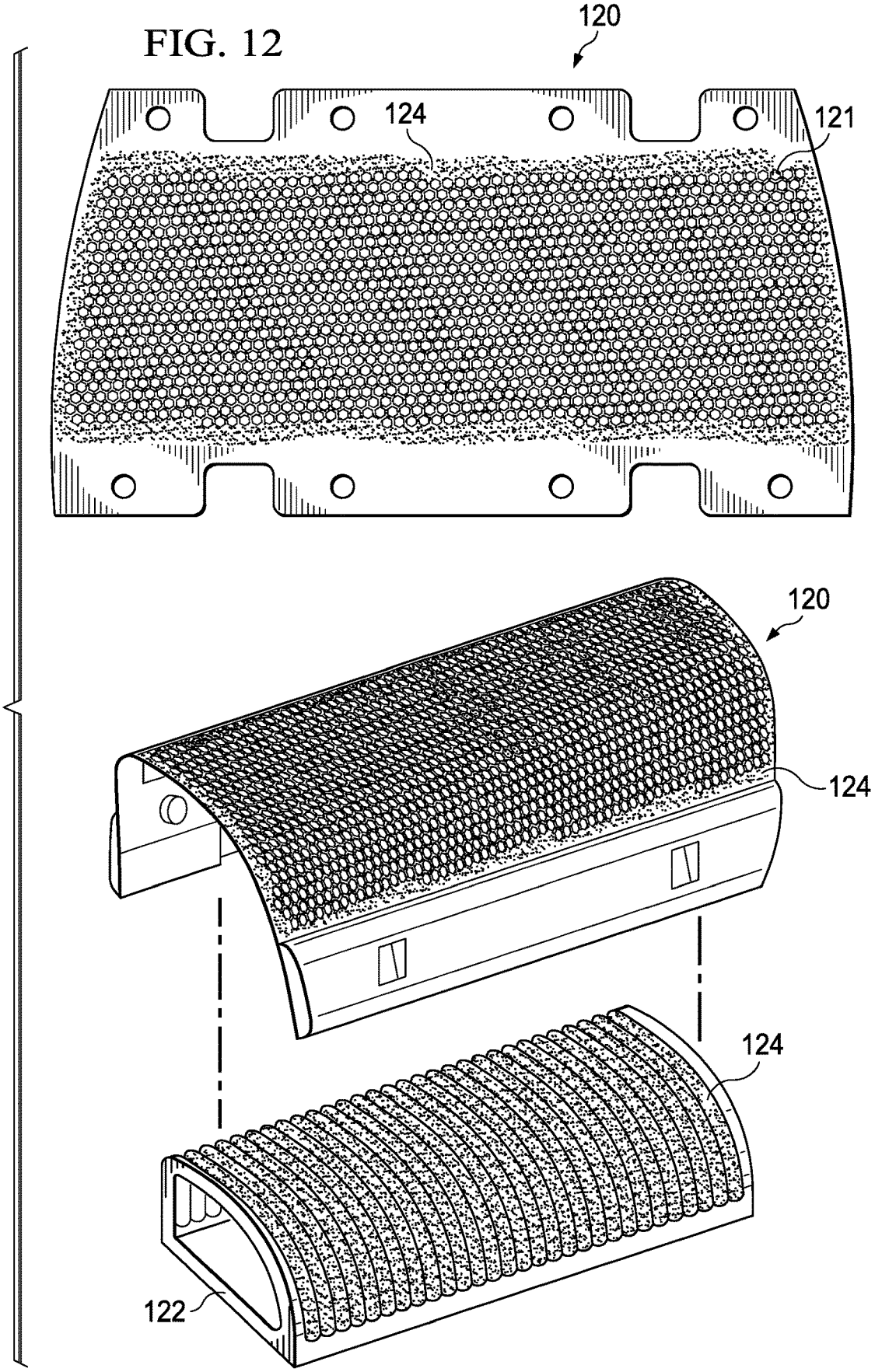
FIG. 12 is a perspective view of dry shaver components having BAM disposed thereon in accordance with the present invention.

Referring to FIG. 12, an example of BAM material 124 disposed on electric dry shaver components, such as on outer and/or inner surfaces of a foil 120 component or dry shaver cutter elements 122 is shown in accordance with another embodiment of the present invention. An electric or dry razor generally consists of a set of oscillating or rotating blades or cutters 122, which are held behind a perforated metal foil 120 which prevents them from coming into contact with the skin and behaves much like the second blade in a pair of scissors. When the razor is held against the skin, the whiskers poke through the holes 121 in the foil 120 and are sliced by the moving cutters 122. Typically, there is no lubricant applied in dry shaving. The addition of a BAM coating, for instance, on the outer surface of the foil, may improve skin glide. Further, an advantage of having a BAM coating on the inner surface of a foil (not shown) may generally include the reduced friction between the foil and cutters, which may provide a cooler shave, increased battery life and/or increased foil longevity. A BAM coating 124 disposed on the outer surface of the cutter elements 122 themselves as shown in FIG. 12, may also desirably provide enhanced hardness of the cutters and reduced friction.

Thus, as described above, with BAM material being used on blade edges, there is a potential to provide a single coating (delivering both hard and lubricious benefits) solution to deliver optimized blade performance and simplified manufacturing. Further, as also described above, the BAM material may be applied to other razor components such as those in the cartridge or on the handle and/or dry shaver components such as foils and cutter elements and in turn provide improved shaving benefits such as wear resistance and lubricity.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor blade apparatus comprising a sharpened substrate having at least one layer of BAM material disposed thereon, wherein one or more overcoat layers comprised of a composite of BAM and a second component is disposed on top of the BAM layer, wherein one or more interlayers are disposed between the layer of BAM material and the sharpened substrate and wherein said one or more interlayers and said one or more overcoat layers comprise an adhesion layer.

2. The razor blade apparatus of claim 1 wherein said at least one layer of BAM material is directly disposed on the sharpened substrate.

3. The razor blade apparatus of claim 1 wherein said adhesion layer is comprised of niobium, chromium, platinum, titanium, or any combination or alloys thereof.

4. The razor blade apparatus of claim 1 wherein at least one polymeric material is disposed on top of the at least one layer of BAM material, on top of said one or more interlayer, or on top of said one or more overcoat layer, or any combination thereof.

5. The razor blade apparatus of claim 4 wherein said at least one polymeric material comprises PTFE.

6. The razor blade apparatus of claim 4 wherein said at least one polymeric material comprises a material with a coefficient of friction greater or lesser than that of PTFE.

7. The razor blade apparatus of claim 1 wherein said second component is a polymeric material.

8. The razor blade apparatus of claim 1 wherein said one or more overcoat layers comprises an increasing concentration of said second component in a direction towards an outer surface of the substrate or a decreasing concentration of said second component in a direction towards an outer surface of the substrate.

9. The razor blade apparatus of claim 1 wherein the at least one layer of BAM material is disposed on the sharpened substrate via physical vapor deposition, chemical vapor deposition, magnetron sputtering, or any combination thereof.

10. The razor blade apparatus of claim 1 wherein the sharpened substrate is comprised of stainless steel, metal, ceramic, composite, plastic, glass, or any combination thereof.

11. The razor blade apparatus of claim 1 wherein the sharpened substrate is on a blade edge of the razor blade wherein said blade edge is linear, non-linear, or any combination thereof.

* * * * *